United States Patent [19]

Koyama et al.

[11] Patent Number: 4,916,899

[45] Date of Patent: Apr. 17, 1990

[54] STATOR SHAFT CONNECTION THROUGH OIL PUMP OF AUTOMATIC TRANSMISSION

[75] Inventors: Takao Koyama, Atsugi; Kazuhiko Sugano, Yokohama, both of Japan

[73] Assignee: Nissan Motor Co., Ltd., Yokohama, Japan

[21] Appl. No.: 264,735

[22] Filed: Oct. 31, 1988

[30] Foreign Application Priority Data

Oct. 30, 1987 [JP] Japan ..... 62-273227

[51] Int. Cl.[4] ..... F04B 39/12

[52] U.S. Cl. ..... 60/358; 418/170

[58] Field of Search ..... 60/358; 418/116, 170, 418/171

[56] References Cited

U.S. PATENT DOCUMENTS

| | | | |
|---|---|---|---|
| 2,910,832 | 11/1959 | Kelley | 60/358 X |
| 3,619,093 | 11/1971 | Harle et al. | 418/171 X |
| 4,645,441 | 2/1987 | Shirai et al. | 418/170 X |
| 4,850,832 | 7/1989 | Murota | 418/170 |

OTHER PUBLICATIONS

Catalog pages describing ZF Oil Pump; from Zahnradfabrik Friedrichshafen AG (West Germany).

*Primary Examiner*—Robert E. Garrett
*Assistant Examiner*—George Kapsalas
*Attorney, Agent, or Firm*—Foley & Lardner, Schwartz, Jeffery, Schwaab, Mack, Blumenthal & Evans

[57] ABSTRACT

An oil pump of an automatic transmission, which comprises a casing having an oil pump gear chamber formed therein, the casing having first and second bores exposed to the oil pump gear chamber, the first and second bores being coaxially spaced from each other with an interposal of the oil pump gear chamber therebetween; gears operatively disposed in the oil pump gear chamber of the casing; a first splined portion formed on a leading end portion of a stator shaft of a torque converter; and a second splined portion formed on an inner surface of the second bore, wherein the stator shaft is thrusted through the first and second bores in this order into a fixed position wherein the first and second splined portions are operatively engaged.

6 Claims, 1 Drawing Sheet

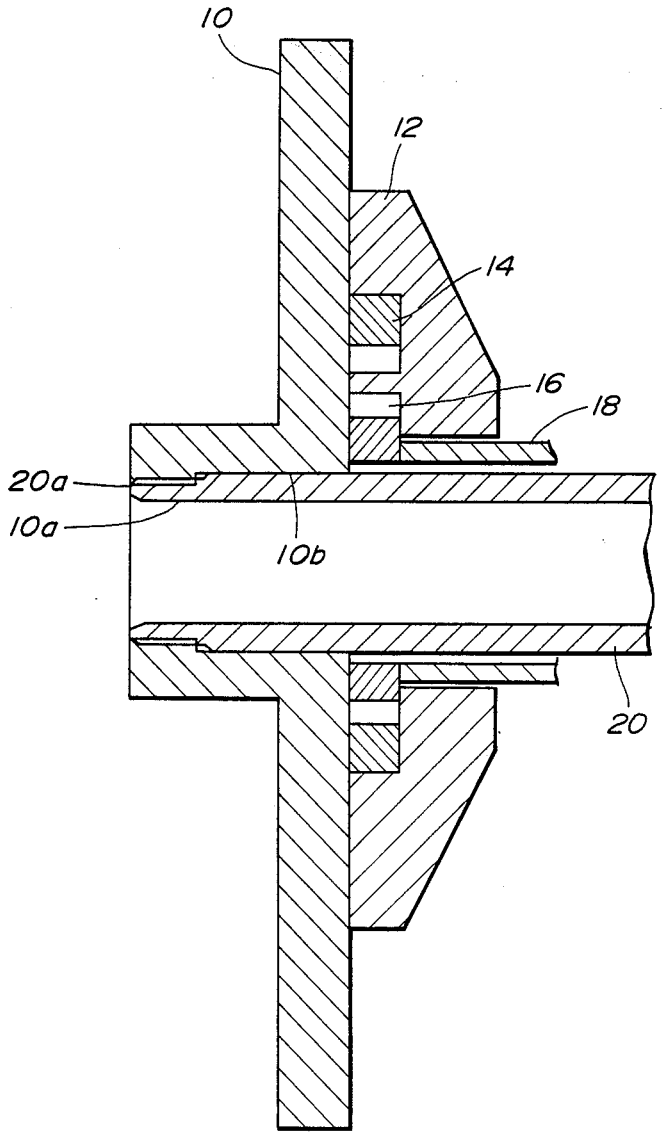
10
12
14
16
18
20a
10a
10b
20

STATOR SHAFT CONNECTION THROUGH OIL PUMP OF AUTOMATIC TRANSMISSION

BACKGROUND OF THE INVENTION

1. Field of the Invention

The present invention relates to an oil pump of an automatic transmission.

2 Description of the Prior Art

Hitherto, various types of oil pumps for automatic transmissions have been proposed and put into practical use particularly in the field of motor vehicles. One of them is disclosed in a catalogue issued from ZAHNRADFABRIK FRIEDRICHSHAFEN AG OF WEST GERMANY. In the oil pump disclosed in this publication, a stator shaft of a torque converter extends through a casing of the oil pump from an outside (viz., the side where an oil pump gears are not provided) of the casing toward an inside (viz., the side where the oil pump gears are provided) of the same. The stator shaft has a portion splined with the oil pump casing, so that rotation of the stator shaft is suppressed.

However, due to its inherent construction, the above-mentioned oil pump has the following drawback. That is, when, for assembling the transmission, the stator shaft is thrust into the oil pump casing, it tends to occur that any burr produced by the splines is led into the gear chamber of the oil pump causing severe wearing and seizing of the gears. In fact, when the stator shaft is thrusted into the oil pump casing, a peripheral part of the opening of the casing may be shaved off by the splines of the stator shaft. Because the stator shaft is thrust into the oil pump casing from the outside toward the inside, the shavings thus produced by the splines are inevitably led into the oil pump gear chamber.

SUMMARY OF THE INVENTION

It is therefore an object of the present invention to provide an oil pump of an automatic transmission which is free of the above-mentioned drawback.

According to the present invention, there is provided an oil pump of an automatic transmission wherein, in case of assembling, the stator shaft of the torque converter is thrusted into the oil pump casing from the inside toward the outside of the casing.

According to the present invention, there is provided, in an automatic transmission having a torque converter with a stator shaft, an oil pump which comprises a casing having an oil pump gear chamber formed therein, the casing having first and second bores exposed to the oil pump gear chamber, the first and second bores being coaxially spaced from each other with an interposal of the oil pump gear chamber therebetween; gears operatively disposed in the oil pump gear chamber of the casing; a first splined portion formed on a leading end portion of the stator shaft; and a second splined portion formed on an inner surface of the second bore, wherein the stator shaft is thrust through the first and second bores in this order into a fixed position wherein the first and second splined portions are operatively engaged.

BRIEF DESCRIPTION OF THE DRAWING

Other objects and advantages of the present invention will become apparent from the following description when taken in conjunction with the accompanying single drawing which is a sectional view of an essential part of the present invention.

DETAILED DESCRIPTION OF THE PREFERRED EMBODIMENT

Referring to the single drawing, there is shown an essential part of the present invention.

Outside and inside members 10 and 12 are combined by means of bolts (not shown) to define therebetween an oil pump gear chamber. The outside member 10 is a part of a front wall of a transmission housing, and the inside member 12 is a part of a rear wall of a torque converter housing. Within the chamber, there are arranged an outer gear 14 and an inner gear 16 in a known manner. The inner gear 16 is rotated with a hollow shaft 18 which is integral with a casing (not shown) of a torque converter (not shown).

The outside member 10 is formed at its center portion with an annular boss. The boss defines therein a stepped bore which comprises a smaller diameter part 10*a* and a larger diameter part 10*b*. The smaller diameter part 10*a* has splines formed on an inner cylindrical wall thereof. Thrusted into the stepped bore is a stator shaft 20 which extends axially in the hollow shaft 18 and has at its leading end portion (viz., a left side end as viewed in the drawing) a smaller diameter splined portion 20*a* engaged with the smaller diameter splined part 10*a* of the bore. Thus, rotation of the stator shaft 20 relative to the outside member 10 is suppressed. The right end portion of the stator shaft 20 is connected to a stator of the torque converter through a one-way clutch.

As will be understood from the abovedescription, in case of assembling, the stator shaft 20 is thrust into oil pump casing from the inside (viz., the side where the outer and inner gears 14 and 16 are provided) of the casing toward the outer side (viz., the side where the stepped bore (10*b*, 10*b*) is positioned) of the casing.

During the thrusting of the stator shaft 20, it may occur that the splines 20a on the stator shaft 20 shave off a peripheral part of the smaller diameter splined part 10*a* of the stepped bore. However, because of the construction as mentioned hereinabove, the shavings produced are forced to discharge from the leftside opening 10a of the bore during the leftward movement of the shaft 20. More specifically, due to the inherent construction, it never occurs that the shavings are led to the oil pump gears 14 and 16.

Thus, the drawback encountered in the above-mentioned conventional oil pump is not encountered in the present invention.

What is claimed is:

1. In an automatic transmission having a torque converter with a stator shaft, an oil pump comprising:

a casing having an oil pump gear chamber formed therein, said casing having first and second bores exposed to said oil pump gear chamber, said first and second bores being coaxially spaced from each other with an interposal of said oil pump gear chamber therebetween;

gears operatively disposed in said oil pump gear chamber of said casing;

a first splined portion formed on a leading end portion of said stator shaft; and a second splined portion formed on an inner surface of said second bore, wherein the stator shaft is thrust through said first and second bores in this order into a fixed position wherein said first and second splined portions are operatively engaged.

2. An oil pump as claimed in claim 1, in which said casing comprises an inside member in which said first bore is defined and an outside member in which said second bore is defined.

3. An oil pump as claimed in claim 2, in which said second bore comprises a larger diameter part located close to said oil pump gear chamber and a smaller diameter part located apart from said oil pump gear chamber, said smaller diameter part being formed at its inner cylindrical wall with said second splined portion.

4. An oil pump as claimed in claim 3, in which an inner cylindrical wall of said first bore of said casing and an outer cylindrical wall of said stator shaft define therebetween an annular space through which a hollow shaft is coaxially and rotatably disposed, said hollow shaft having one end connected with one of said gears and the other end integral with a casing of the torque converter.

5. An oil pump as claimed in claim 4, in which said one of said gears is an inner gear of the oil pump.

6. An oil pump as claimed in claim 2, in which said inside member is a part of a rear wall of the torque converter housing, and said outside member is a part of a front wall of the transmission housing.

* * * * *